US011119524B1

(12) United States Patent
Dougherty et al.

(10) Patent No.: US 11,119,524 B1
(45) Date of Patent: Sep. 14, 2021

(54) GLITCH MITIGATION IN SELECTABLE OUTPUT CURRENT MIRRORS WITH DEGENERATION RESISTORS

(71) Applicant: Cirrus Logic International Semiconductor Ltd., Edinburgh (GB)

(72) Inventors: Christopher M. Dougherty, Austin, TX (US); Anindya Bhattacharya, Austin, TX (US); Vaibhav Pandey, Austin, TX (US); Ying Ou, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 22 days.

(21) Appl. No.: 16/815,505

(22) Filed: Mar. 11, 2020

(51) Int. Cl.
*G05F 3/26* (2006.01)

(52) U.S. Cl.
CPC ..... *G05F 3/262* (2013.01)

(58) Field of Classification Search
CPC ..... G05F 3/26–267
See application file for complete search history.

(56) References Cited

U.S. PATENT DOCUMENTS 4,967,140 A * 10/1990 Groeneveld ..... G05F 3/262 323/315
7,514,989 B1 * 4/2009 Somerville ..... G05F 3/26 327/538
2004/0263241 A1 * 12/2004 Fujikura ..... G05F 3/262 327/543
2006/0238235 A1 * 10/2006 Wey ..... G05F 3/265 327/543
2012/0044012 A1 * 2/2012 Shibayama ..... G05F 3/30 327/437
2014/0277268 A1 * 9/2014 Lee ..... H03K 3/023 607/46
2014/0333368 A1 * 11/2014 Bell ..... G05F 3/262 327/517
2015/0301551 A1 * 10/2015 Childs ..... H02M 3/156 323/313
2019/0140656 A1 * 5/2019 Downey ..... H03M 1/785

* cited by examiner

*Primary Examiner* — Fred E Finch, III
(74) *Attorney, Agent, or Firm* — Jackson Walker L.L.P.

(57) ABSTRACT

A selectable output current mirror may include a reference leg configured to generate a reference current, an output leg electrically coupled to the reference leg in a manner such that the output leg is configured to generate at an output of the output leg an output current proportional to the reference current, wherein the output leg comprises an output leg transistor, a drain path switch coupled between a first non-gate terminal of the output leg transistor and the output of the output leg, and a series combination of a degeneration resistor and a degeneration path switch coupled between a second non-gate terminal of the output leg transistor and a voltage source to the selectable output current mirror. The selectable output current mirror may also include switch control circuitry configured to selectively enable and disable the output leg from generating the output current by selectively enabling and disabling the drain path switch and the degeneration path switch and glitch mitigation circuitry coupled to the second non-gate terminal of the output leg transistor and configured to maintain the second non-gate terminal of the output leg transistor at a substantially-constant voltage during transitions between disabling of the degeneration path switch and enabling of the degeneration path switch.

21 Claims, 3 Drawing Sheets

GLITCH MITIGATION IN SELECTABLE OUTPUT CURRENT MIRRORS WITH DEGENERATION RESISTORS

FIELD OF DISCLOSURE

The present disclosure relates in general to circuits for audio devices, piezoelectric devices, and/or haptic-feedback devices, including without limitation personal audio devices such as wireless telephones and media players, and more specifically, to glitch mitigation in selectable output current mirrors with degeneration resistors.

BACKGROUND

Oftentimes, each of various components of an electronic device may receive electrical energy in the form of an electrical current. In some applications, a selectable output current mirror may be used to generate a plurality of electrical currents for use by various components of an electronic device. As is known in the art, a current mirror is a device that may comprise a reference leg in which a reference current is generated and one or more output legs, wherein each leg is configured to generate a respective output current proportional to the reference current. In a selectable output current mirror, each of the one or more output legs of the current mirror may include switching circuitry to selectively enable and disable generation of electrical current from such output leg. Accordingly, a selectable output current mirror may conserve electrical energy by withdrawing electrical current from components of an electronic device which may be inactive or may otherwise be powered down.

In many instances, a selectable output current mirror may include in each of its legs a degeneration resistor coupled between a voltage source of the selectable output current mirror and a source terminal of a transistor integral to such leg. The presence of degeneration resistors may reduce flicker noise within the selectable output current mirror. However, the presence of degeneration resistors may cause an electrical glitch due to current "kick back" that may occur when switching circuitry of an output leg is switched from off to on in order to enable current generation from the output leg. Such glitch may be caused by a sudden change in a voltage at a source terminal of a transistor integral to an output leg due to current through the degeneration resistor increasing from zero to the output current of the leg when the switching circuitry is turned on. Accompanied with the sudden change in voltage at the source terminal of the transistor may be a change in the transistor's operating point, including a change in an effective channel charge of the transistor. Any charge leaving or accumulating in the channel may cause a reflected change in charge at the transistor's gate terminal, due to a capacitance that exists between the source and gate terminals. This charge deviation at the gate may affect current generation in each output leg as the various transistors of each leg may have their gate terminals coupled together to a common bias voltage, meaning such glitch may cause a transient on the common bias voltage, and a corresponding glitch in the output current of one or more output legs of the current mirror.

SUMMARY

In accordance with the teachings of the present disclosure, one or more disadvantages and problems associated with existing approaches to protecting against electrical glitches in a selectable output may be reduced or eliminated.

In accordance with embodiments of the present disclosure, a selectable output current mirror may include a reference leg configured to generate a reference current, an output leg electrically coupled to the reference leg in a manner such that the output leg is configured to generate at an output of the output leg an output current proportional to the reference current, wherein the output leg comprises an output leg transistor, a drain path switch coupled between a first non-gate terminal of the output leg transistor and the output of the output leg, and a series combination of a degeneration resistor and a degeneration path switch coupled between a second non-gate terminal of the output leg transistor and a voltage source to the selectable output current mirror. The selectable output current mirror may also include switch control circuitry configured to selectively enable and disable the output leg from generating the output current by selectively enabling and disabling the drain path switch and the degeneration path switch and glitch mitigation circuitry coupled to the second non-gate terminal of the output leg transistor and configured to maintain the second non-gate terminal of the output leg transistor at a substantially-constant voltage during transitions between disabling of the degeneration path switch and enabling of the degeneration path switch.

In accordance with these and other embodiments of the present disclosure, a method may include, in a selectable output current mirror comprising a reference leg configured to generate a reference current, an output leg electrically coupled to the reference leg in a manner such that the output leg is configured to generate at an output of the output leg an output current proportional to the reference current, wherein the output leg comprises an output leg transistor, a drain path switch coupled between a first non-gate terminal of the output leg transistor and the output of the output leg, and a series combination of a degeneration resistor and a degeneration path switch coupled between a second non-gate terminal of the output leg transistor and a voltage source to the selectable output current mirror, selectively enabling and disabling the output leg from generating the output current by selectively enabling and disabling the drain path switch and the degeneration path switch and maintaining the second non-gate terminal of the output leg transistor at a substantially-constant voltage during transitions between disabling of the degeneration path switch and enabling of the degeneration path switch.

In accordance with these and other embodiments of the present disclosure, a device may comprise an electronic component and a selectable output current mirror configured to deliver an output current to the electronic component. The selectable output current mirror may include a reference leg configured to generate a reference current, an output leg electrically coupled to the reference leg in a manner such that the output leg is configured to generate at an output of the output leg the output current proportional to the reference current, wherein the output leg comprises an output leg transistor, a drain path switch coupled between a first non-gate terminal of the output leg transistor and the output of the output leg, and a series combination of a degeneration resistor and a degeneration path switch coupled between a second non-gate terminal of the output leg transistor and a voltage source to the selectable output current mirror. The selectable output current mirror may also include switch control circuitry configured to selectively enable and disable the output leg from generating the output current by selectively enabling and disabling the drain path switch and the degeneration path switch and glitch mitigation circuitry coupled to the second non-gate terminal of the output leg transistor and configured to maintain the second non-gate terminal of the output leg transistor at a substantially-constant voltage during transitions between disabling of the degeneration path switch and enabling of the degeneration path switch.

Technical advantages of the present disclosure may be readily apparent to one skilled in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1:
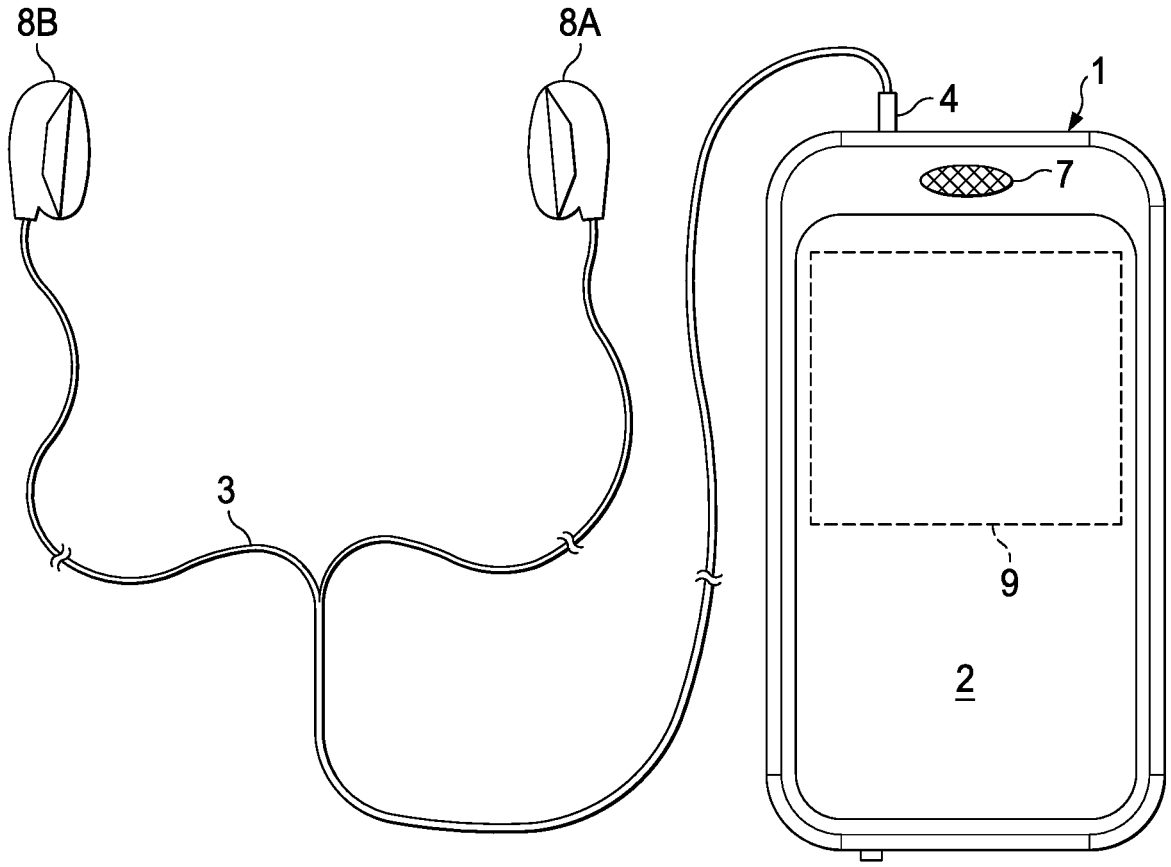
FIG. 1 illustrates an example personal mobile device, in accordance with embodiments of the present disclosure.

FIG. 1 illustrates an example personal mobile device 1, in accordance with embodiments of the present disclosure. FIG. 1 depicts personal mobile device 1 having a speaker 7. Speaker 7 is merely an example, and it is understood that personal mobile device 1 may be used in connection with a variety of transducers including magnetic coil loudspeakers, piezo speakers, haptic feedback transducers, and others. In addition or alternatively, personal mobile device 1 may be coupled to a headset 3 in the form of a pair of earbud speakers 8A and 8B. Headset 3 depicted in FIG. 1 is merely an example, and it is understood that personal mobile device 1 may be used in connection with a variety of audio transducers, including without limitation, headphones, earbuds, in-ear earphones, and external speakers. A plug 4 may provide for connection of headset 3 to an electrical terminal of personal mobile device 1. Personal mobile device 1 may provide a display to a user and receive user input using a touch screen 2, or alternatively, a standard liquid crystal display (LCD) may be combined with various buttons, sliders, and/or dials disposed on the face and/or sides of personal mobile device 1. As also shown in FIG. 1, personal mobile device 1 may include an integrated circuit (IC) 9 for generating an analog signal for transmission to speaker 7, headset 3, and/or another transducer.

Figure 2:
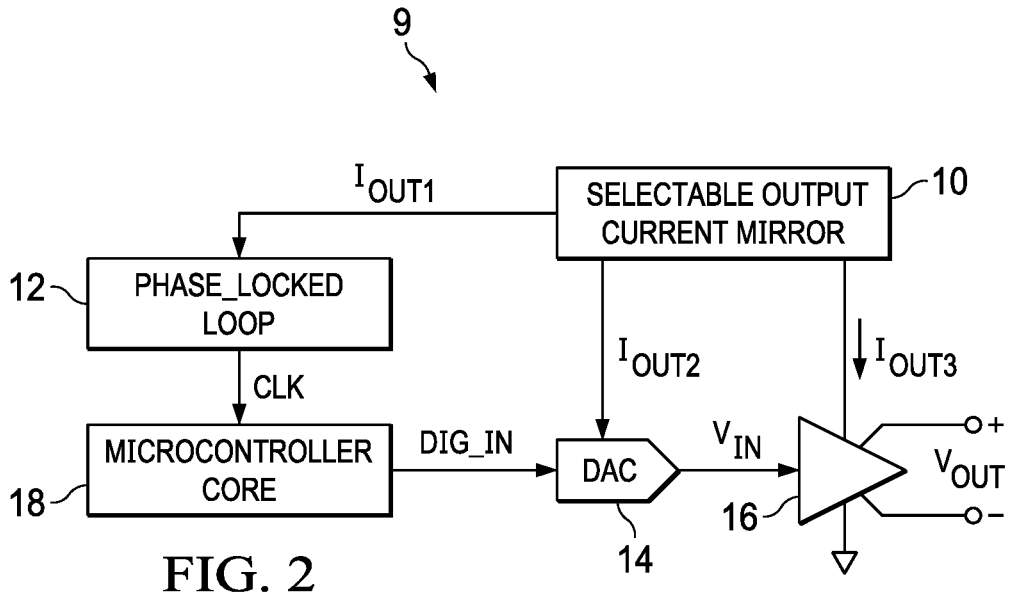
FIG. 2 illustrates a block diagram of selected components of an example integrated circuit of a personal mobile device for driving a transducer, in accordance with embodiments of the present disclosure.

FIG. 2 illustrates a block diagram of selected components of an example IC 9 of a personal mobile device for driving a transducer, in accordance with embodiments of the present disclosure. As shown in FIG. 2, a microcontroller core 18, which may be synchronized by a clock signal CLK generated by a phase-locked loop 12, may supply a digital input signal DIG_IN to a digital-to-analog converter (DAC) 14, which may convert the digital input signal to an analog input signal $V_{IN}$. DAC 14 may supply analog signal $V_{IN}$ to an amplifier 16 which may amplify or attenuate analog input signal $V_{IN}$ to provide a differential audio output signal \Tom', which may operate a speaker, a headphone transducer, a piezoelectric transducer, a haptic feedback transducer, a line level signal output, and/or other suitable output. In some embodiments, DAC 14 may be an integral component of amplifier 16.

A selectable output current mirror 10 may provide electrical energy to and/or provide an electrical bias signal to phase-locked loop 12, DAC 14, and amplifier 16 in the form of respective electrical currents $I_{OUT1}$, $I_{OUT2}$, and $I_{OUT3}$. As its name implies, one or more of the outputs of selectable output current mirror 10 may be selectively enabled and disabled to generate output current only when desired or needed by the component powered by such output current. For example, in IC 9 as shown in FIG. 2, it may be desirable that microcontroller core 18 is always powered on, but that DAC 14 and amplifier 16 be powered off when no signal DIG_IN is being driven. In such cases, selectable output current mirror 10 may disable outputs of selectable output current mirror 10 such that currents $I_{OUT2}$ and $I_{OUT3}$ are zero.

Although FIGS. 1 and 2 contemplate that IC 9 resides in a personal mobile device, systems and methods described herein may also be applied to electrical and electronic systems and devices other than a personal mobile device, including transducer systems for use in a computing device larger than a personal mobile device, an automobile, a building, or other structure.

Furthermore, IC 9 as shown in FIG. 2 represents merely one instance in which a selectable output current mirror may be used. It is understood that a selectable output current mirror may be used in any electric or electronic device in which it is desirable to have a current mirror with at least one selectively enabled and disabled output.

Figure 3:
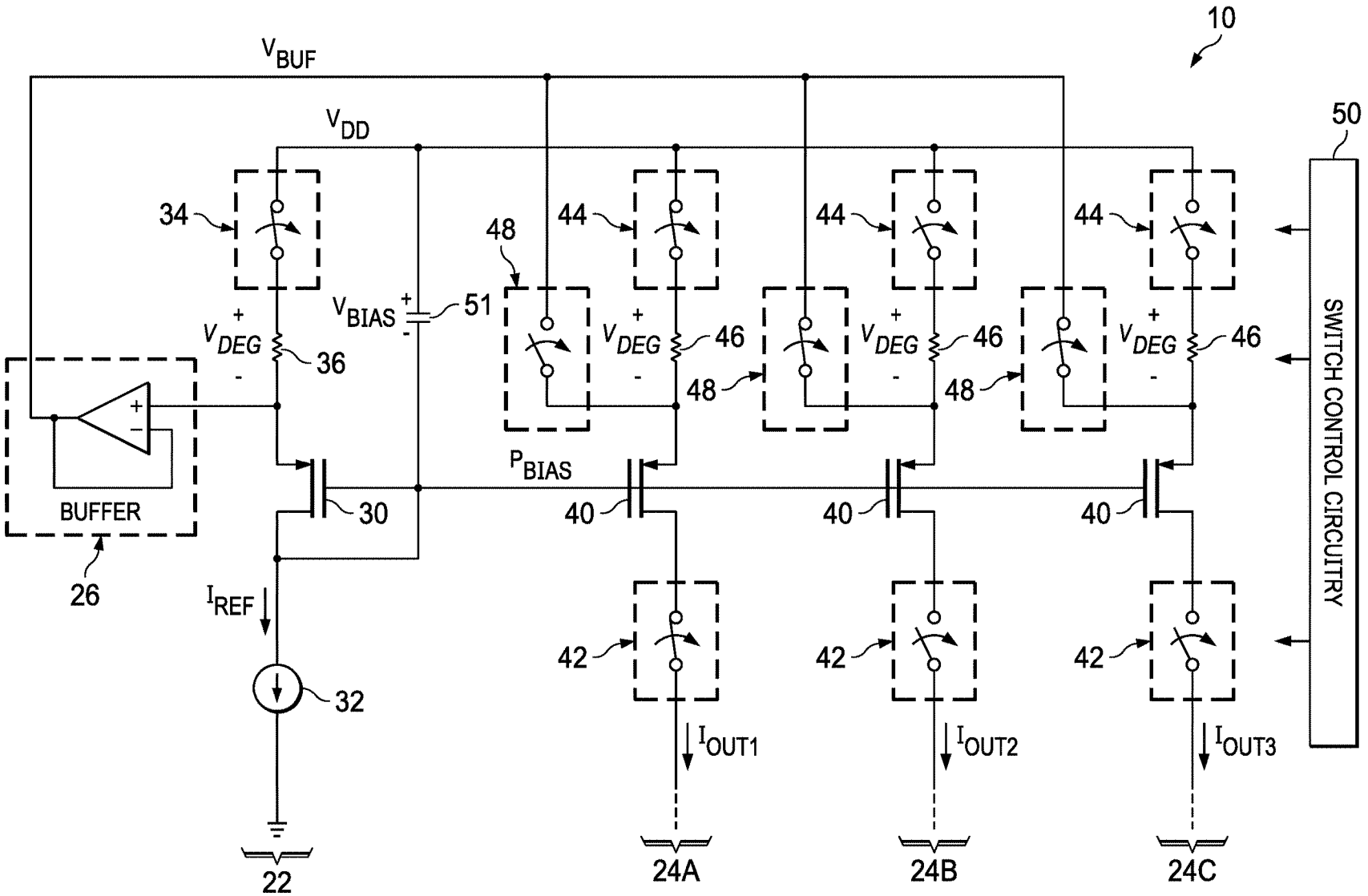
FIG. 3 illustrates a block diagram of selected components of an example selectable output current mirror, in accordance with embodiments of the present disclosure.

FIG. 3 illustrates a block diagram of selected components of an example selectable output current mirror 10, in accordance with embodiments of the present disclosure. As shown in FIG. 3, selectable output current mirror 10 may comprise a reference leg 22, one or more output legs 24 (e.g., output legs 24A, 24B, 24C), a buffer 26, and switch control circuitry 50.

Reference leg 22 may comprise a transistor 30, a current source 32, a degeneration path switch 34, and a degeneration path resistor 36. Transistor 30 may have its gate terminal and drain terminal coupled together, and current source 32 may be coupled between the drain terminal of transistor 30 and a ground voltage such that a reference current $I_{REF}$ generated by current source 32 flows from the drain terminal of transistor 30. Degeneration path switch 34 and degeneration resistor 36 may be coupled in series between a voltage source $V_{DD}$ and a source terminal of transistor 30. Although FIG. 3 depicts degeneration path switch 34 coupled between voltage source $V_{DD}$ and degeneration path resistor 36 and degeneration path resistor 36 coupled between degeneration path switch 34 and the source terminal of transistor 30, in some embodiments, degeneration path resistor 36 may be coupled between voltage source $V_{DD}$ and degeneration path switch 34, and degeneration path switch 34 may be coupled between degeneration path resistor 36 and the source terminal of transistor 30.

Each output leg 24 may comprise a transistor 40, a drain path switch 42, a degeneration path switch 44, a degeneration path resistor 46, and a holding path switch 48. A gate transistor of transistor 40 may have its gate terminal coupled to the gate terminal of transistor 30 of reference leg 22, such that the gate terminals of transistor 30 and all transistors 40 are all coupled to one another at a common voltage node having a voltage $P_{BIAS}$. Drain path switch 42 may be coupled between the drain terminal of transistor 40 and an output of selectable output current mirror 10 such that when drain path switch 42 (and degeneration path switch 44) of output leg 24 is enabled (e.g., activated, on, closed), an electrical current (e.g., $I_{OUT1}$, $I_{OUT2}$, $I_{OUT3}$) proportional to reference current $I_{REF}$ is delivered from such output, and when drain path switch 42 (and degeneration path switch 44) of output leg 24 is disabled (e.g., deactivated, off, open), no current is generated from output leg 24 to its respective output. Degeneration path switch 44 and degeneration resistor 46 may be coupled in series between a voltage source $V_{DD}$ and a source terminal of transistor 40. Although FIG. 3 depicts degeneration path switch 44 coupled between voltage source $V_{DD}$ and degeneration path resistor 46 and degeneration path resistor 46 coupled between degeneration path switch 44 and the source terminal of transistor 40, in some embodiments, degeneration path resistor 46 may be coupled between voltage source $V_{DD}$ and degeneration path switch 44 and degeneration path switch 44 may be coupled between degeneration path resistor 46 and the source terminal of transistor 40. Holding path switch 48 may be coupled between the output of buffer 26 and the source terminal of transistor 40.

Although FIG. 3 depicts three output legs 24, it is understood that selectable output current mirror 10 may include any suitable number of output legs 24, including a single output leg 24 or any suitable plurality of output legs 24.

Selectable output current mirror 10 may also include a bias capacitor 51 coupled between voltage source $V_{DD}$ and the common voltage node. Bias capacitor 51 may assist in maintaining a constant voltage $V_{BIAS}$ between voltage source $V_{DD}$ and voltage $P_{BIAS}$.

Buffer 26 may be coupled via its input to the source terminal of transistor 30 and coupled at its output to holding path switch 48 of each of the one or more output legs 24. Buffer 26 may comprise any suitable system, device, or apparatus configured to generate at its output a buffer output voltage $V_{BUF}$ approximately equal to a voltage present at the source terminal of transistor 30. Thus, the buffer output voltage $V_{BUF}$ may be given as:

$$V_{BUF}=V_{DD}-V_{DEG}$$

wherein $V_{DEG}$ is voltage across degeneration resistor 36.

Switch control circuitry 50 may have a plurality of outputs, each output for carrying a control signal for selectively enabling and disabling a respective drain path switch 42, degeneration path switch 34, degeneration path switch 44, or holding path switch 48. For the purposes of clarity, connectivity between outputs of switch control circuitry 50 and individual control inputs of drain path switches 42, degeneration path switch 34, degeneration path switches 44, or holding path switches 48 is not shown in FIG. 3.

In operation, switch control circuitry 50 may enable a given output leg 24 to generate an output current by enabling drain path switch 42 and degeneration path switch 44 of the given output leg 24. Similarly, switch control circuitry 50 may disable a given output leg 24 from generating an output current by disabling drain path switch 42 and degeneration path switch 44 of the given output leg 24.

Furthermore, to maintain an approximately constant voltage at the source terminal of the transistor 40 of a given output leg 24, switch control circuitry 50 may enable holding path switch 48 of the given output leg 24 when drain path switch 42 and degeneration path switch 44 of the given output leg 24 are being transitioned from enabled to disabled or vice versa. In order words, at a short time before given output leg 24 when drain path switch 42 and degeneration path switch 44 of the given output leg 24 are transitioned from enabled to disabled or vice versa, switch control circuitry 50 may enable holding path switch 48 of the given output leg 24 and disable holding path switch 48 of the given output leg 24 once the switching transitions of drain path switch 42 and degeneration path switch 44 of the given output leg 24 are complete. Thus, an output leg 24 that is disabled may have its respective holding path switch 48 enabled until a subsequent transition of the output leg from disabled to enabled, which may maintain the disabled output leg 24 in approximately the same operating point as enabled output legs 24.

To illustrate an advantage of this approach, when holding path switch 48 of a given output leg 24 is enabled, it may pass buffer output voltage $V_{BUF}$ to the source terminal of the transistor 40 of the given output leg 24. $V_{BUF}$ may be approximately equal to a voltage $V_{DD}-V_{DEG}$ present on the source terminal of the transistor 40 of the given output leg 24 when drain path switch 42 and degeneration path switch 44 of the given output leg 24 are enabled. Thus, when switch control circuitry 50 causes drain path switch 42 and degeneration path switch 44 of the given output leg 24 to transition from enabled to disabled (and vice versa), the change in voltage at the source terminal of the transistor 40 of the given output leg 24 may be approximately zero, and thus no sudden change in voltage may be coupled from the source terminal of the transistor 40 of the given output leg 24 to the voltage node common to the gate terminals of transistors 30 and 40.

Figure 4:
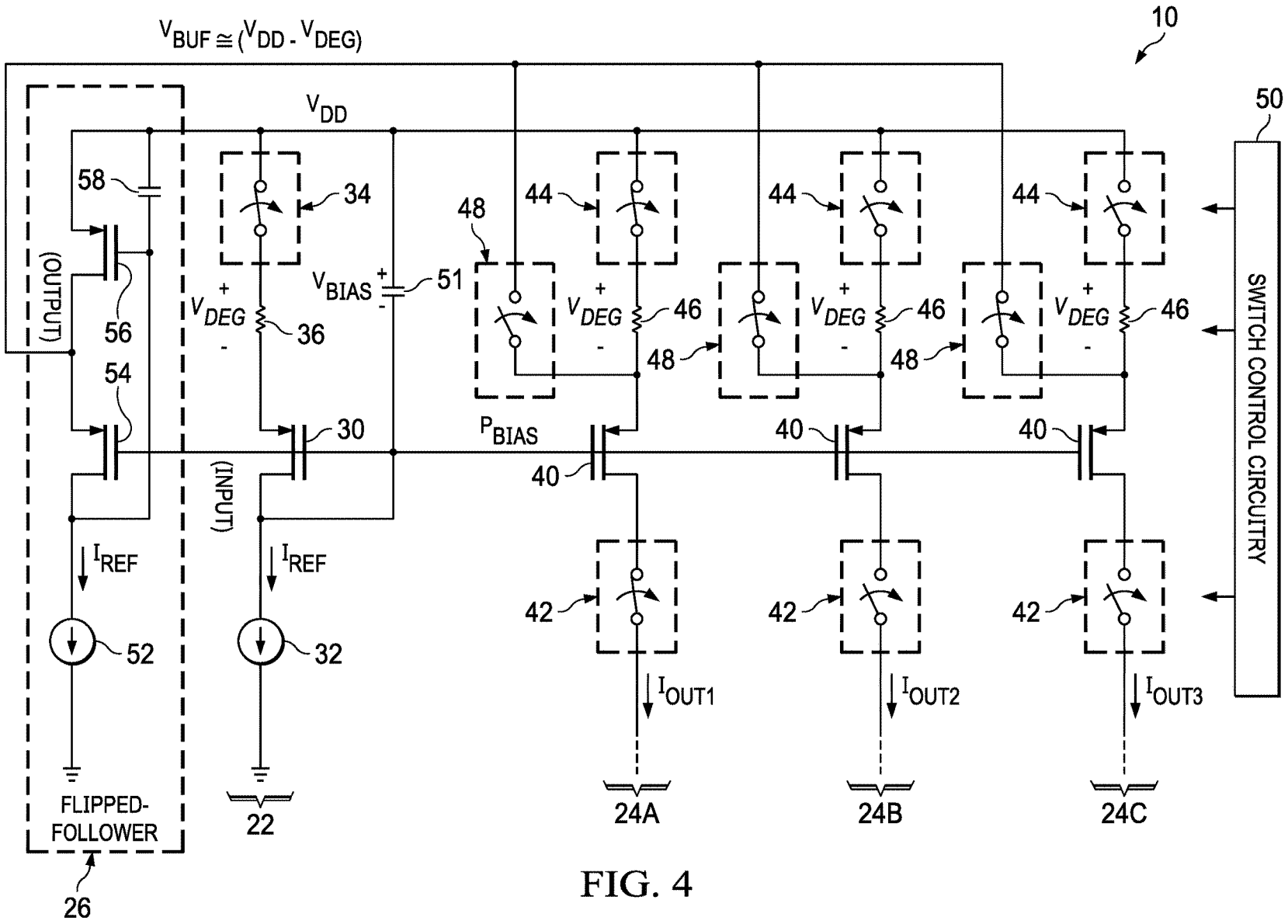
FIG. 4 illustrates a block diagram of selected components of the example selectable output current mirror shown in FIG. 3 with detail of selected components of an example buffer, in accordance with embodiments of the present disclosure.

FIG. 4 illustrates a block diagram of selected components of example selectable output current mirror shown 10 in FIG. 3 with detail of selected components of an example buffer 26, in accordance with embodiments of the present disclosure. While any suitable implementation or architecture of buffer 26 may be used, in the embodiments represented by FIG. 4, buffer 26 may be implemented with a flipped-follower comprising a current source 52, transistor 54, transistor 56, and compensation capacitor 58.

Current source 52 may be coupled between the drain terminal of transistor 54 and a ground voltage such that a reference current $I_{REF}$ generated by current source 52 flows from the drain terminal of transistor 54. In some embodiments, current source 52 may be equivalent in many respects to current source 32.

Transistor 54 may be coupled at its gate terminal to the common voltage node having a voltage $P_{BIAS}$. Transistor 56 may be coupled at its gate terminal to the drain terminal of transistor 54, coupled at its drain terminal to a source terminal of transistor 54, and coupled at its source terminal to voltage source $V_{DD}$. Compensation capacitor 58 may be coupled between the gate terminal of transistor 56 and voltage source $V_{DD}$. Although shown in FIG. 4, compensation capacitor 58 may not be present in some embodiments of buffer 26. Those of skill in the art may recognize that as arranged in FIG. 4, buffer 26 may generate at its output (e.g., the electrical node common to the drain terminal of transistor 56 and the source terminal of transistor 54) buffer output voltage approximately equal to a voltage $V_{DD}-V_{DEG}$.

One advantage to the methods and systems disclosed herein is that, the architecture shown in FIGS. 3 and 4 and described herein may require a lower capacitance of bias capacitor 51 to maintain bias voltage $V_{BIAS}$ at an acceptably constant level as compared with capacitances required in existing architectures of selectable output current mirrors.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative. Accordingly, modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described above.

Unless otherwise specifically noted, articles depicted in the drawings are not necessarily drawn to scale.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

Although specific advantages have been enumerated above, various embodiments may include some, none, or all of the enumerated advantages. Additionally, other technical advantages may become readily apparent to one of ordinary skill in the art after review of the foregoing figures and description.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

What is claimed is:

1. A selectable output current mirror comprising:

a reference leg configured to generate a reference current;

an output leg electrically coupled to the reference leg in a manner such that the output leg is configured to generate at an output of the output leg an output current proportional to the reference current, wherein the output leg comprises:

an output leg transistor;

a drain path switch coupled between a first non-gate terminal of the output leg transistor and the output of the output leg; and a series combination of a degeneration resistor and a degeneration path switch coupled between a second non-gate terminal of the output leg transistor and a voltage source to the selectable output current mirror;

switch control circuitry configured to selectively enable and disable the output leg from generating the output current by selectively enabling and disabling the drain path switch and the degeneration path switch; and glitch mitigation circuitry coupled to the second non-gate terminal of the output leg transistor and configured to maintain the second non-gate terminal of the output leg transistor at a substantially-constant voltage during transitions between disabling of the degeneration path switch and enabling of the degeneration path switch.

2. The selectable output current mirror of claim 1, wherein the glitch mitigation circuitry comprises:

a buffer configured to generate the substantially-constant voltage at a buffer output; and a holding path switch coupled between the buffer output and the second non-gate terminal of the output leg transistor;

wherein the glitch mitigation circuitry is further configured to selectively enable and disable the holding path switch from passing the substantially-constant voltage from the buffer output to the second non-gate terminal of the output leg transistor.

3. The selectable output current mirror of claim 2, wherein the buffer comprises a flipped follower, wherein the flipped follower comprises:

a current source configured to generate the reference current;

a first transistor coupled at a first non-gate terminal of the first transistor to the current source and coupled at a gate terminal of the first transistor to a gate terminal of the output leg transistor; and a second transistor coupled at a first non-gate terminal of the second transistor to a second non-gate terminal of the first transistor, coupled at a second non-gate terminal of the second transistor to the voltage source to the selectable output current mirror, and coupled at its gate terminal to the first non-gate terminal of the first transistor;

such that the flipped follower generates the substantially-constant voltage at the first non-gate terminal of the second transistor.

4. The selectable output current mirror of claim 2, wherein the flipped follower further comprises a compensation capacitor coupled between the gate terminal of the second transistor and the second non-gate terminal of the second transistor.

5. The selectable output current mirror of claim 2, wherein the switch control circuitry is configured to:

enable the holding path switch before a transition between disabling of the degeneration path switch and enabling of the degeneration path switch; and disable the holding path switch after the transition between disabling of the degeneration path switch and enabling of the degeneration path switch.

6. The selectable output current mirror of claim 1, wherein the reference leg comprises:

a reference leg transistor coupled via its gate terminal to a gate terminal of the output leg transistor, having its gate terminal and a first non-gate terminal of the reference leg transistor coupled together, and having the current source coupled to the first non-gate terminal of the reference leg transistor; and a series combination of a second degeneration resistor and a second degeneration path switch coupled between a second non-gate terminal of the transistor and the voltage source to the selectable output current mirror.

7. The selectable output current mirror of claim 1, wherein the glitch mitigation circuitry causes the substantially-constant voltage to be approximately equal to a voltage present at the second terminal of the output leg transistor during times in which the degeneration path switch is enabled.

8. A method comprising, in a selectable output current mirror comprising a reference leg configured to generate a reference current, an output leg electrically coupled to the reference leg in a manner such that the output leg is configured to generate at an output of the output leg an output current proportional to the reference current, wherein the output leg comprises an output leg transistor, a drain path switch coupled between a first non-gate terminal of the output leg transistor and the output of the output leg, and a series combination of a degeneration resistor and a degeneration path switch coupled between a second non-gate terminal of the output leg transistor and a voltage source to the selectable output current mirror;

selectively enabling and disabling the output leg from generating the output current by selectively enabling and disabling the drain path switch and the degeneration path switch; and maintaining the second non-gate terminal of the output leg transistor at a substantially-constant voltage during transitions between disabling of the degeneration path switch and enabling of the degeneration path switch.

9. The method of claim 8, wherein maintaining the second non-gate terminal of the output leg transistor at a substantially-constant voltage during transitions between disabling of the degeneration path switch and enabling of the degeneration path switch comprises:

generating the substantially-constant voltage at a buffer output; and selectively enabling and disabling a holding path switch coupled between the buffer output and the second non-gate terminal of the output leg transistor from passing the substantially-constant voltage from the buffer output to the second non-gate terminal of the output leg transistor.

10. The method of claim 9, wherein the buffer output is generated by a buffer comprising a flipped follower, wherein the flipped follower comprises:

a current source configured to generate the reference current;

a first transistor coupled at a first non-gate terminal of the first transistor to the current source and coupled at a gate terminal of the first transistor to a gate terminal of the output leg transistor; and a second transistor coupled at a first non-gate terminal of the second transistor to a second non-gate terminal of the first transistor, coupled at a second non-gate terminal of the second transistor to the voltage source to the selectable output current mirror, and coupled at its gate terminal to the first non-gate terminal of the first transistor;

such that the flipped follower generates the substantially-constant voltage at the first non-gate terminal of the second transistor.

11. The method of claim 9, wherein the flipped follower further comprises a compensation capacitor coupled between the gate terminal of the second transistor and the second non-gate terminal of the second transistor.

12. The method of claim 9, further comprising:

enabling the holding path switch before a transition between disabling of the degeneration path switch and enabling of the degeneration path switch; and disabling the holding path switch after the transition between disabling of the degeneration path switch and enabling of the degeneration path switch.

13. The method of claim 8, wherein the reference leg comprises:

a reference leg transistor coupled via its gate terminal to a gate terminal of the output leg transistor, having its gate terminal and a first non-gate terminal of the reference leg transistor coupled together, and having the current source coupled to the first non-gate terminal of the reference leg transistor; and a series combination of a second degeneration resistor and a second degeneration path switch coupled between a second non-gate terminal of the transistor and the voltage source to the selectable output current mirror.

14. The method of claim 8, further comprising causing the substantially-constant voltage to be approximately equal to a voltage present at the second terminal of the output leg transistor during times in which the degeneration path switch is enabled.

15. A device comprising:

an electronic component; and a selectable output current mirror configured to deliver an output current to the electronic component, the selectable output current mirror comprising:

a reference leg configured to generate a reference current;

an output leg electrically coupled to the reference leg in a manner such that the output leg is configured to generate at an output of the output leg an output current proportional to the reference current, wherein the output leg comprises:

an output leg transistor;

a drain path switch coupled between a first non-gate terminal of the output leg transistor and the output of the output leg; and a series combination of a degeneration resistor and a degeneration path switch coupled between a second non-gate terminal of the output leg transistor and a voltage source to the selectable output current mirror;

switch control circuitry configured to selectively enable and disable the output leg from generating the output current by selectively enabling and disabling the drain path switch and the degeneration path switch; and glitch mitigation circuitry coupled to the second non-gate terminal of the output leg transistor and configured to maintain the second non-gate terminal of the output leg transistor at a substantially-constant voltage during transitions between disabling of the degeneration path switch and enabling of the degeneration path switch.

16. The device of claim 15, wherein the glitch mitigation circuitry comprises:

a buffer configured to generate the substantially-constant voltage at a buffer output; and a holding path switch coupled between the buffer output and the second non-gate terminal of the output leg transistor;

wherein the glitch mitigation circuitry is further configured to selectively enable and disable the holding path switch from passing the substantially-constant voltage from the buffer output to the second non-gate terminal of the output leg transistor.

17. The device of claim 16, wherein the buffer comprises a flipped follower, wherein the flipped follower comprises:

a current source configured to generate the reference current;

a first transistor coupled at a first non-gate terminal of the first transistor to the current source and coupled at a gate terminal of the first transistor to a gate terminal of the output leg transistor; and a second transistor coupled at a first non-gate terminal of the second transistor to a second non-gate terminal of the first transistor, coupled at a second non-gate terminal of the second transistor to the voltage source to the selectable output current mirror, and coupled at its gate terminal to the first non-gate terminal of the first transistor;

such that the flipped follower generates the substantially-constant voltage at the first non-gate terminal of the second transistor.

18. The device of claim 16, wherein the flipped follower further comprises a compensation capacitor coupled between the gate terminal of the second transistor and the second non-gate terminal of the second transistor.

19. The device of claim 16, wherein the switch control circuitry is configured to:

enable the holding path switch before a transition between disabling of the degeneration path switch and enabling of the degeneration path switch; and disable the holding path switch after the transition between disabling of the degeneration path switch and enabling of the degeneration path switch.

20. The device of claim 15, wherein the reference leg comprises:

a reference leg transistor coupled via its gate terminal to a gate terminal of the output leg transistor, having its gate terminal and a first non-gate terminal of the reference leg transistor coupled together, and having the current source coupled to the first non-gate terminal of the reference leg transistor; and a series combination of a second degeneration resistor and a second degeneration path switch coupled between a second non-gate terminal of the transistor and the voltage source to the selectable output current mirror.

21. The device of claim 15, wherein the glitch mitigation circuitry causes the substantially-constant voltage to be approximately equal to a voltage present at the second terminal of the output leg transistor during times in which the degeneration path switch is enabled.

* * * * *